United States Patent [19]

Sinclair

[11] Patent Number: 4,636,131

[45] Date of Patent: Jan. 13, 1987

[54] SIDE SHIFTER AND NARROW AISLE ATTACHMENT FOR A LIFT TRUCK

[75] Inventor: Stuart W. Sinclair, Lake Jackson, Tex.

[73] Assignee: Long Reach Manufacturing Co., Houston, Tex.

[21] Appl. No.: 719,591

[22] Filed: Apr. 3, 1985

[51] Int. Cl.[4] ..... B66F 9/14

[52] U.S. Cl. ..... 414/621; 414/666; 414/669; 414/670; 414/667; 414/749; 414/607; 414/662; 414/785; 414/917; 414/751

[58] Field of Search ..... 414/662, 663, 664, 665, 414/666, 667, 668, 669, 670, 671, 672, 607, 608, 749, 750, 751, 752, 753, 281, 282; 414/283, 277, 253, 255, 256, 917, 619, 621, 918, 785

[56] References Cited

U.S. PATENT DOCUMENTS

| | | | |
|---|---|---|---|
| 3,474,985 | 10/1969 | Brudi et al. | 414/667 X |
| 3,567,055 | 3/1971 | Preto | 414/668 |
| 3,598,264 | 8/1971 | Massie | 414/664 |
| 3,659,733 | 5/1972 | Sinclair | 414/670 |
| 3,672,526 | 6/1972 | Hansen | 414/666 |
| 3,762,588 | 10/1973 | Hansen et al. | 414/666 |
| 3,984,019 | 10/1976 | Brudi et al. | 414/917 X |
| 4,279,564 | 7/1981 | Weinert | 414/621 |
| 4,389,152 | 6/1983 | Palm | 414/694 |
| 4,400,984 | 8/1983 | Rönbeck | 414/749 X |

*Primary Examiner*—Frank E. Werner
*Attorney, Agent, or Firm*—Fulbright & Jaworski

[57] ABSTRACT

An attachment for lift trucks to enable the truck to work in narrow aisles and manipulate loads in front of and to both sides of the truck without turning the truck. A side shifter which includes a pair of parallel moving arms for supporting the load in which the arms are pivotally supported from a track intermediate the ends of the arms. The side shifter retracts within the width of the truck, but extends beyond the sides of the truck for handling loads.

3 Claims, 11 Drawing Figures

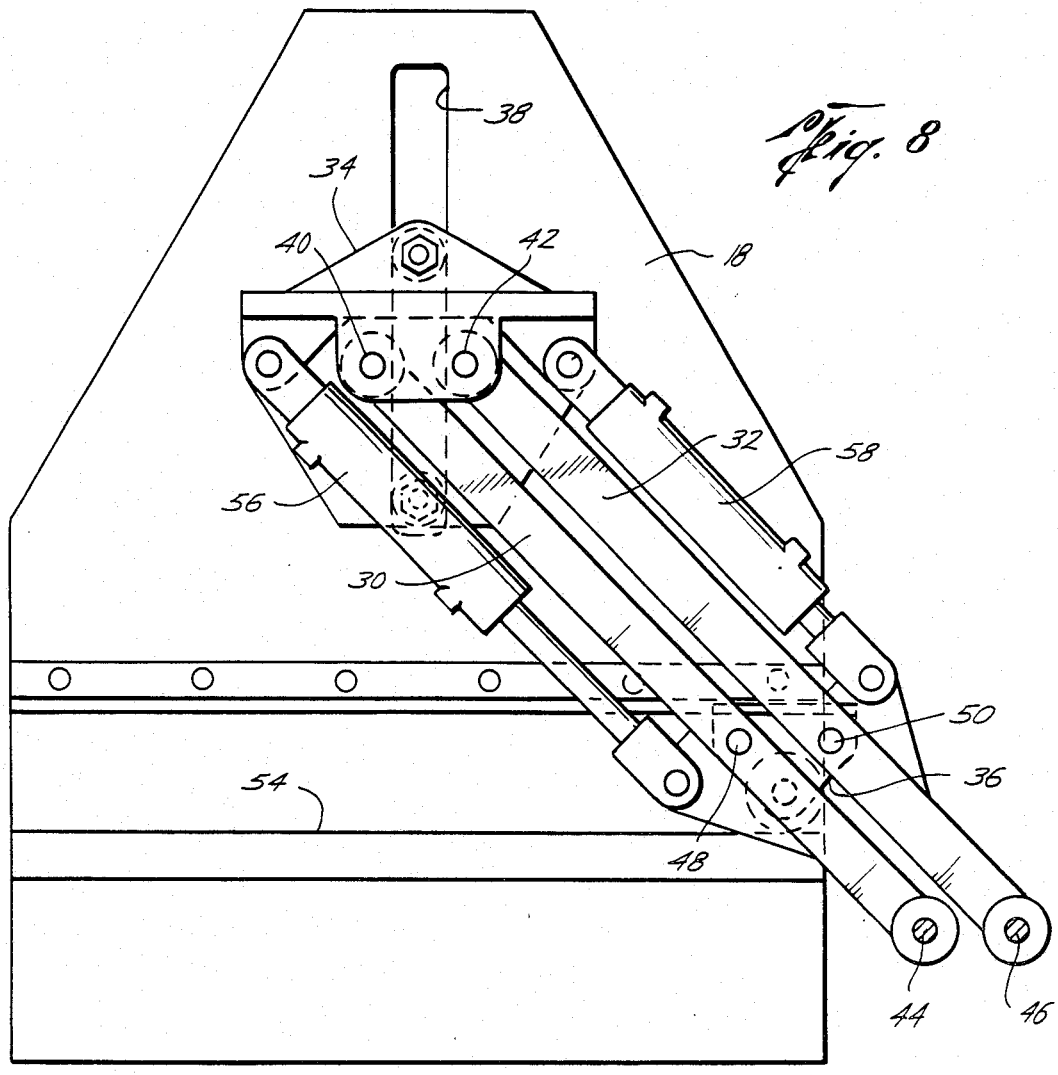
Fig. 8
Fig. 9
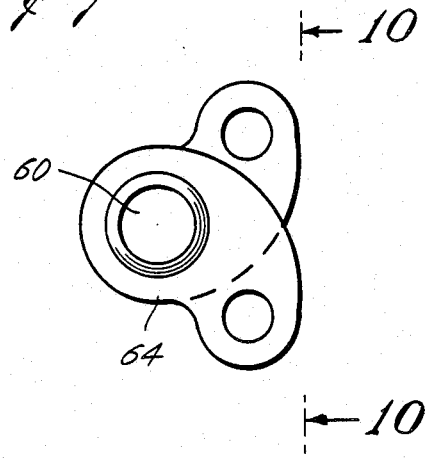
Fig. 10
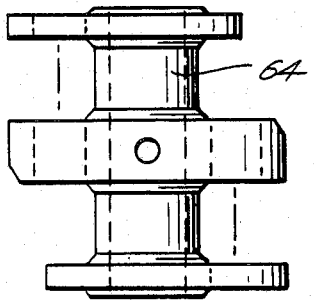

SIDE SHIFTER AND NARROW AISLE ATTACHMENT FOR A LIFT TRUCK

BACKGROUND OF THE INVENTION

It is well known, as illustrated in U.S. Pat. No. 3,659,733, to provide an attachment for a lift truck for operating and working in narrow aisles. A narrow aisle attachment enables the truck to manipulate loads and/or pallets in front of and at both sides of the truck without requiring the truck to turn in the aisle.

The present invention is directed to a side shifter, which has various uses, but is particularly useful in a narrow aisle attachment which is no wider than the standard front carriage plate of the truck thereby not requiring an increased aisle width for the truck. However, the attachment is capable of being extended beyond either side of the truck for engaging or releasing loads.

SUMMARY

The present invention is directed to a narrow aisle attachment for use with a lift truck comprising a carriage plate adapted to be supported from the lift truck, side shifter means supported from the carriage plate, a yoke assembly supported from the side shifter means, a load handling assembly rotatably supported from the yoke, and means connected to the load handling assembly for rotating the load handling assembly. The side shifter means includes a pair of moving parallel arms with a head assembly connected to and vertically moving on the carriage plate and pivotally connected to each of the parallel arms. One of the ends of each of the parallel arms is pivotally connected to the yoke. Power means are connected between the head assembly and the parallel arms for shifting the arms transversely to the carriage plate. A dolly assembly is pivotally connected to each of the arms between the ends of the arms, and a support track positioned on the carriage plate supports the dolly assembly. The attachment, in the retracted position, is contained within the width of the carriage plate. The side shifter means allows the load handling assembly to be manipulated transversely of the truck and allows the load handling assembly to extend beyond either side of the truck when the assembly is rotated 90° from the truck axis.

Still a further object of the present invention is wherein the support track is straight and extends the width of the carriage plate, but the ends of the parallel arms may extend and carry the load handling assembly beyond the width of the carriage plate.

Still a further object of the present invention is wherein the dolly assembly is pivotally connected to each of the arms at locations approximately one-third of the length of the arms from the bottom of the arms.

Still a further object is wherein the dolly assembly movably supports power lines for the rotating means.

Yet a further object of the present invention is the provision of a carriage plate adapted to be supported from the lift plate, and side shifter means supported from the carriage plate. The side shifter includes a pair of movable parallel arms and a head assembly is vertically movable in the carriage plate and pivotally connected to the top ends of each of the parallel arms. The lower ends of the parallel arms include pivotal connections. A hydraulic piston and cylinder assembly is connected between the parallel arms and the head assembly for shifting the arms transversely to the carriage plate.

A dolly assembly, including a wheel, is pivotally connected to each of the arms between the ends of the arms. A support track is positioned on the carriage plate for supporting the wheel. The support truck may be straight or may be curved for moving the load handling means transversely in a straight line.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 8 is a cross-sectional view taken along the line 8—8 of FIG. 7, FIG. 9 is a cross-sectional view taken along the line 9—9 of FIG. 4, FIG. 10 is a cross-sectional view taken along the line 10—10 of FIG. 9.

DESCRIPTION OF THE PREFERRED EMBODIMENTS

Figure 1:
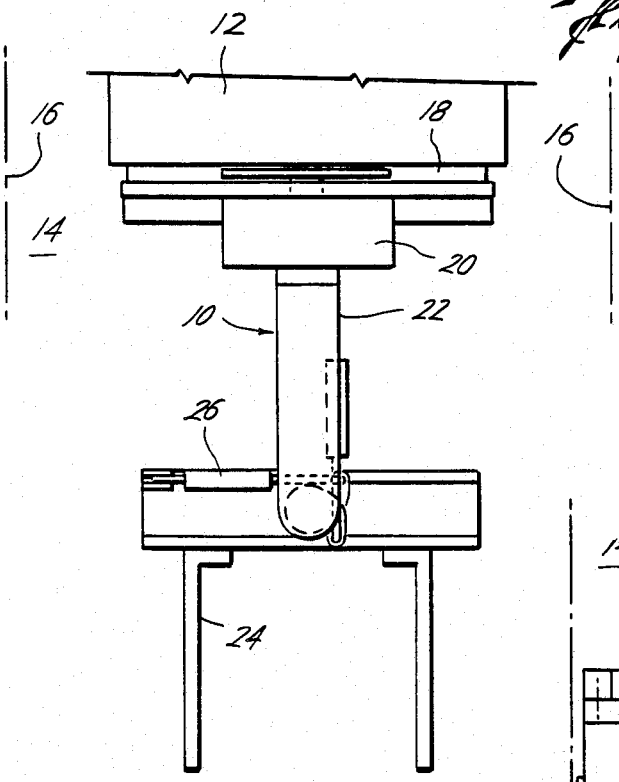
FIG. 1 is a schematic elevational view illustrating the attachment of the present invention positioned for carrying a load in front of a lift truck.
Figure 2:
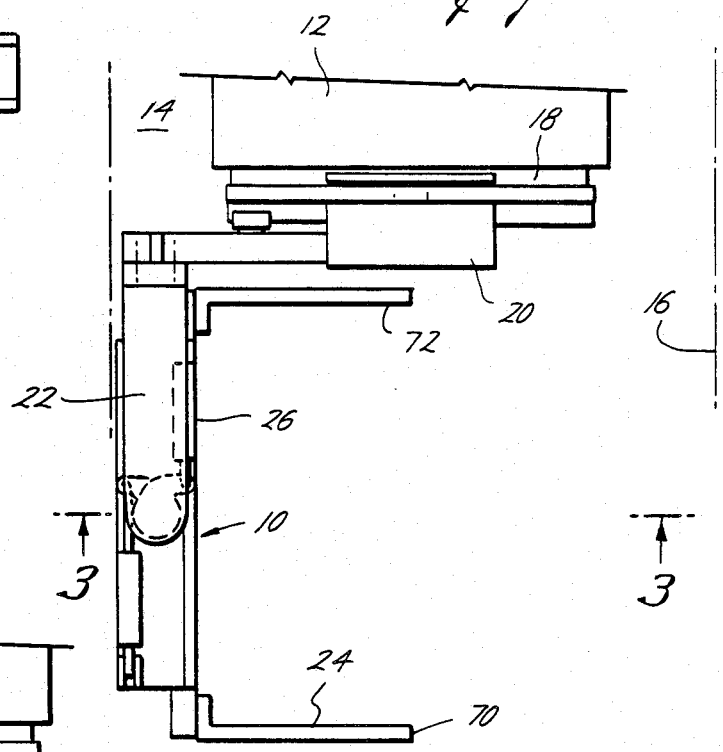
FIG. 2 is a view similar to that of FIG. 1 in which the attachment has been shifted to one side and rotated 90° in preparation to pick up a load at the side.
Figure 7:
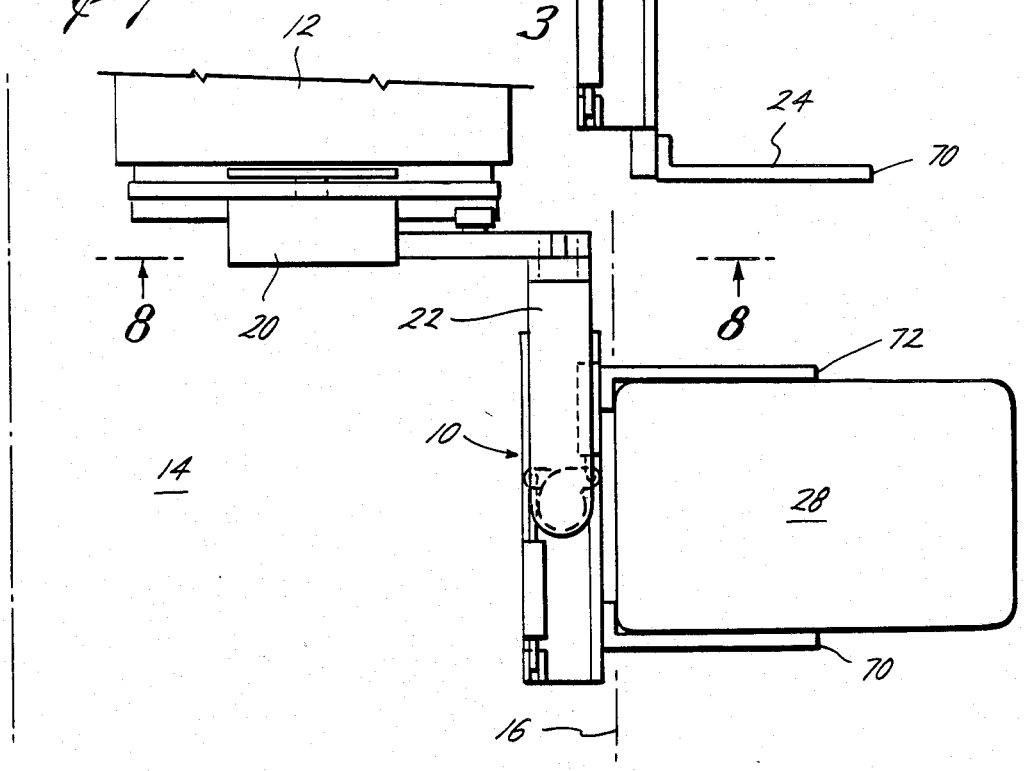
FIG. 7 is a schematic view similar to FIGS. 1 and 2 showing the attachment of the present invention in position for picking up a load from the side.

While the side shifter of the present invention may be used in other types of attachments for a lift truck it will be described in connection with a narrow aisle attachment. Referring now to the drawings, and particularly to FIGS. 1, 2 and 7, the reference numeral 10 generally refers to the narrow aisle attachment of the present invention which is mounted on a conventional industrial lift truck 12 which is moving down an aisle 14 between stacks 16. The attachment 10 includes a carriage plate 18 for connection to the lift truck 12, includes a side shifter mechanism 20 supported from the plate 18, a load supporting member or yoke 22 supported from the side shifter 20, a load handling assembly 24 here shown as cotton bale clamps, although any other type of load handling assembly may be used such as forks for lifting palleted loads, and rotating means 26 connected to the load handling assembly 24 for rotating the load handling assembly 90° to each side.

As shown in FIG. 1, the truck 12 may move down the aisle 14 between the stacks 16 with the narrow aisle attachment 10 axially aligned therewith for carrying a load, or as shown for approaching a location to pick up a load. It is noted that the attachment 10 in the position shown in FIG. 1 is no wider than the width of the truck 12 so that the truck 12 may be easily maneuvered down the aisle 14.

Referring now to FIG. 2, the truck 12 has moved into position in the aisle 14 to pick up a load and the side shifter mechanism 20 has been actuated to shift the yoke 22 to the right (as seen from the position of the truck operator) and the rotative means 26 has been actuated to rotate the load handling assembly 24 90° towards the left for alignment with a load. (Vertical alignment of the load handling assembly 24 is accomplished as is conventional by raising or lowering the carriage plate 18 on the truck 12.)

As best seen in FIG. 7, the side shifter means 20 has shifted the yoke 22 transversely to the axis of the truck 12 to the lefthand side of the truck 12 and the load handling assembly 24 has been actuated to engage and grip a load 28 such as a bale of cotton in the stack 16. Thereafter, the cycle is reversed and the attachment 10 returns to its position of FIG. 1 carrying the load 28. Thereafter, the truck 10 may transport the load 28 to a desired location.

The above general description of a narrow aisle attachment is shown in U.S. Pat. No. 3,659,733.

Figure 4:
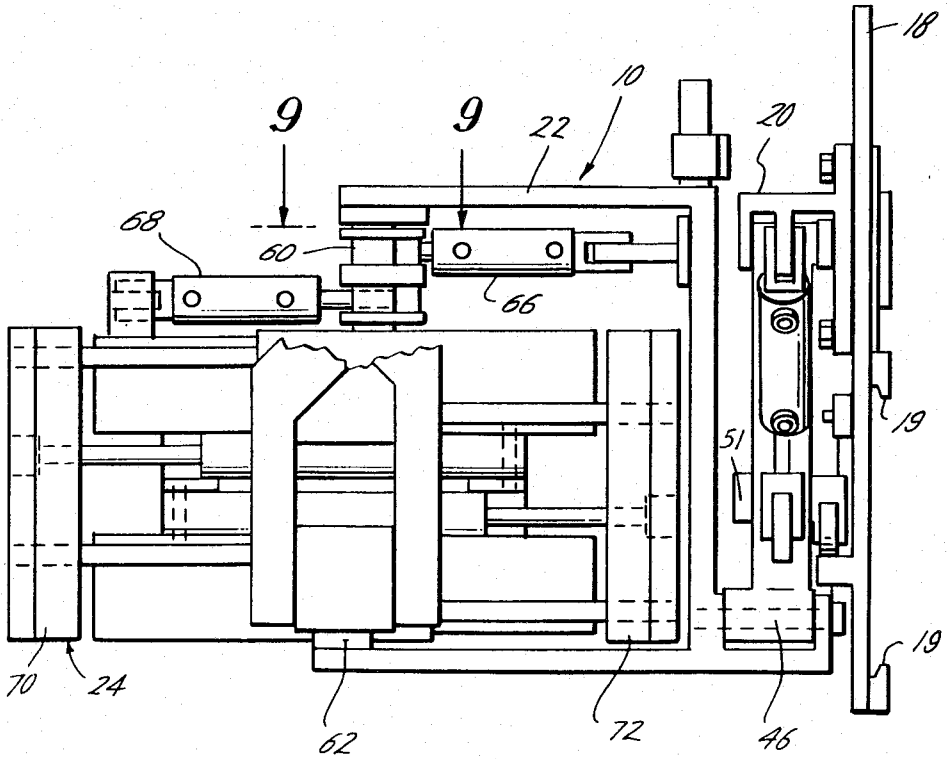
FIG. 4 is a side elevational view of the apparatus of FIG. 3.
Figure 3:
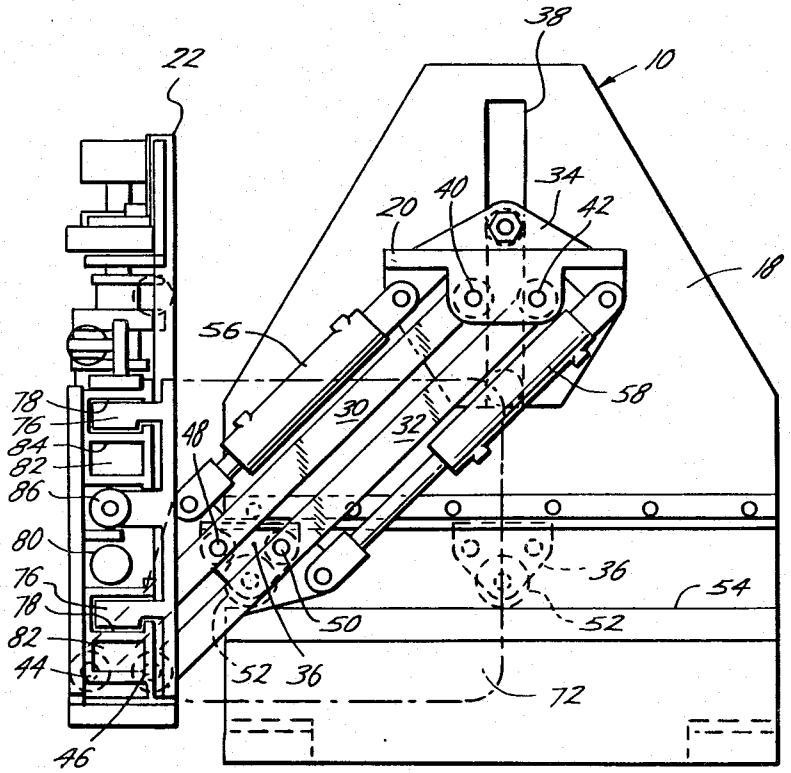
FIG. 3 is a cross-sectional view taken along of the line 3—3 of FIG. 2.

Referring now to FIGS. 3 and 4, the attachment 10 is shown in the position illustrated in FIG. 2. The carriage plate 18 includes hooks 19 for attachment to the truck 12. The side shifter means 20 includes a pair of parallel arms 30 and 32, a head assembly 34, and a dolly assembly 36. The head assembly 34 is connected to and is vertically movable in a vertical extending slot 38 on the carriage plate 18. The upper ends of the parallel arms 30 and 32 are pivotally connected at pivots 40 and 42 to the movable head assembly 34. The lower end of the parallel arms 30 and 32 are pivotally connected and support the yoke 22 at pivot points 44 and 46, respectively.

The dolly assembly 36 is pivotally connected to each of the parallel arms 30 and 32 at pivot points 48 and 50, respectively. The dolly assembly 36 includes a wheel 52 which moves on a track 54 which is transversely mounted on the carriage plate 18. Power means are connected between the head assembly 34 and the parallel arms 30 and 32 for shifting the arms 30 and 32 across the track 54 thereby carrying the yoke 22 and the load handling assembly 24 transversely to the carriage plate 18. Preferably, the power means include a hydraulic piston and cylinder assembly 56 pivotally connected between head 34 and arm 30 and a hydraulic piston and cylinder assembly 58 pivotally connected between the head 34 and arm 32. Actuation of the piston and cylinder assemblies 56 and 58 therefore act to side shift the load handling assembly 24. As the parallel arms 30 and 32 move from one side to the other of the carriage plate 18 from the position shown in FIG. 3 to the position shown in FIG. 8, the dolly assembly 36 moves along the track 54. This causes the head assembly 34 to move upwardly and downwardly with a vertical motion in the slot 38 of the carriage plate 18. It is to be particularly noted that the pivot points 40 and 42 at the upper ends of the parallel arms 30 and 32 move in the same horizontal plane. Similarly, the pivot points 48 and 50 move in another horizontal plane and similarly the pivot points 44 and 46 at the lower ends of the arms 30 and 32 move in another horizontal parallel plane. Thus, the parallel arms 30 and 32 remain parallel at all times thereby holding the yoke 22 in a vertical position at all times. It is also to be particularly noted that the dolly 36 moves upon the tracks 54 which is preferably the same length as the width of the carriage 18; therefore, the nonmoving parts of the attachment 10 do not extend beyond the sides of the truck 12. However, because the yoke 22 and the load handling assembly 24 is supported from the lower ends of the parallel arms 30 and 32 at pivot points 44 and 46, the attachment 10 may be operated so as to be extended beyond the sides of the truck 12 for using the maximum width of the aisle 16 for picking up and delivering loads 28. Preferably the pivot points 48 and 50 which are connected to the dolly 36 are located approximately one-third of the length of the arms 30 and 32 above the lower ends of the arms 30 and 32 for strength, providing extension of the attachment 10 beyond the sides of the truck 12, and at the same time minimizing the elliptical path of the movement of the lower pivot points 44 and 46. If desired, the elliptical path of travel of the pivot points 44 and 46 may be eliminated by making the track 54 of an elliptical shape instead of straight as shown as will be more fully described hereinafter.

Figure 6:
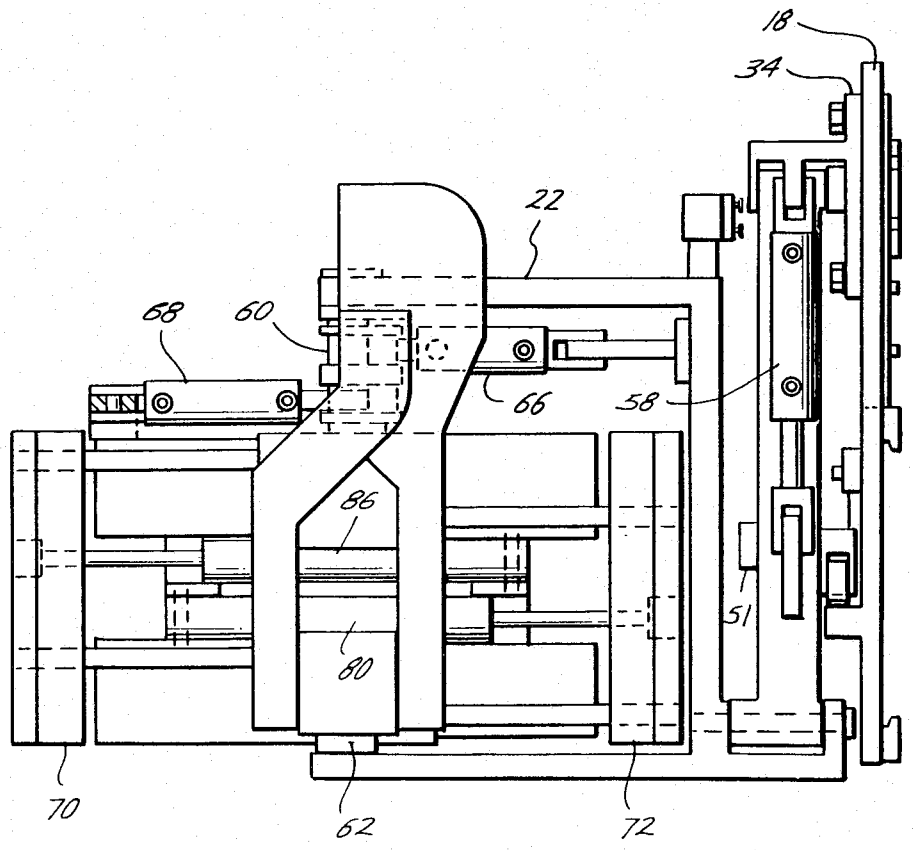
FIG. 6 is a side elevational view of the apparatus shown in FIG. 5.
Figure 5:
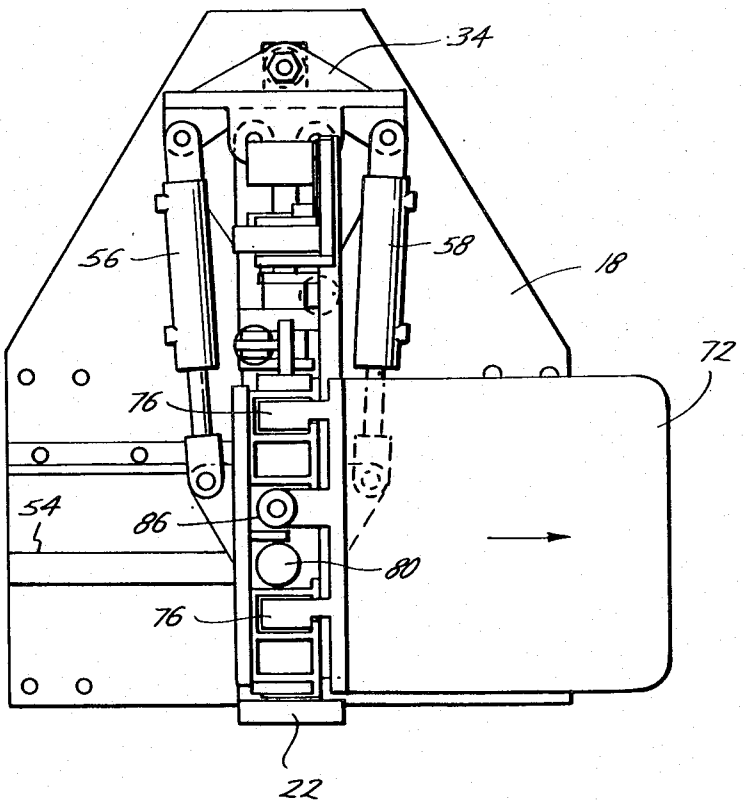
FIG. 5 is a view similar to FIG. 3 showing the side shifting mechanism in an intermediate position moving the load handling assembly from one side towards the other side of the truck.

Referring to FIGS. 5 and 6, the attachment 10 is shown in an intermediate position between that of FIGS. 2 and 3 where the attachment is shifted to the right side and to the position of FIGS. 7 and 8 wherein the attachment 10 is fully shifted to the left side of the truck 12. In this position, the head assembly 34 is at its maximum vertical position in the carriage plate 18. The present side shifter means thereby provides a shifting mechanism contained in the width of the lift truck carriage plate 18, securely supports the load, and allows the load handling assembly 22 to be manipulated transversely of the truck and to extend beyond either side of the lift truck 12.

Referring now to FIGS. 4 and 6, the yoke 22 supports the load handling assembly 24 by upper and lower pivot pins 60 and 62 in which the upper pin 60 is connected to a bell crank 64 as best seen in FIGS. 9 and 10 for rotating the load handling means 24 to either the right or the left of the truck 12. To accomplish this, power means such as hydraulic piston and cylinder assemblies 66 and 68 are connected between the yoke 22 and the bell crank 64 for performing the desired rotation.

While the load handling assembly 24 may be forks, paper roll clamps, or other mechanisms, for purpose of illustration only they are herewith shown as cotton bale clamps consisting of arms 70 and 72 which can be moved towards and away from each other for gripping and releasing a cotton bale 28. Each of the arms 70 and 72 are supported on tracks and actuated by power means. Thus, arms 72 include supports 76 which move in tracks 78 which are actuated by hydraulic piston cylinder assembly 80. Similarly, arm 70 is connected to supports 82 moving in tracks 84 which are connected to and actuated by hydraulic piston cylinder 86.

Referring to FIGS. 4 and 6, a hydraulic fluid hose junction traveling block is supported from the dolly 36 for supporting and carrying the fluid power lines to the hydraulic piston and cylinder assemblies 66, 68, 80 and 86.

Figure 11:
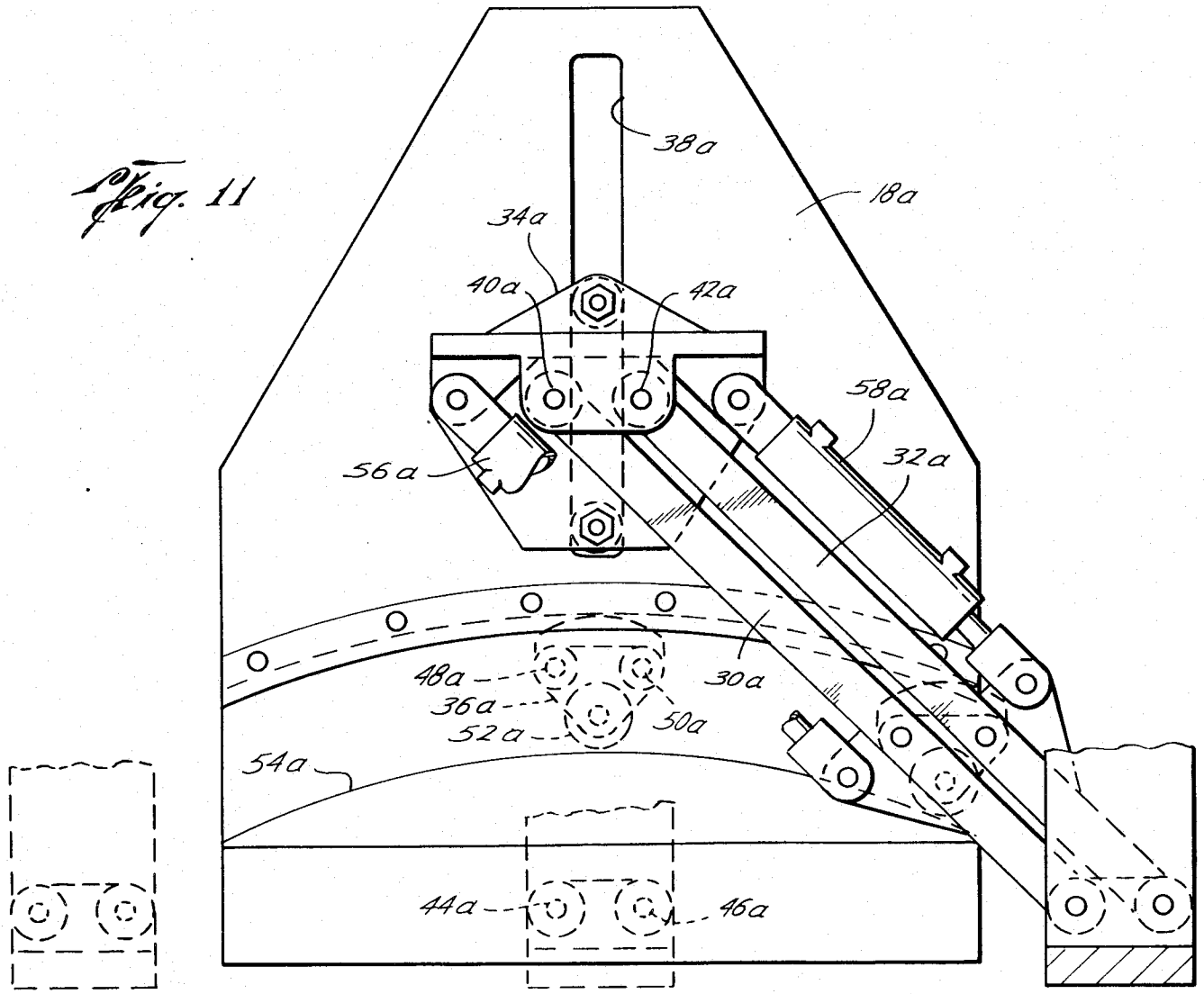
FIG. 11 is an elevational view of the side shifter assembly using a curved track.

Other and further embodiments may be provided such as the side shifter shown in FIG. 11 in which like parts to those shown in FIGS. 1–10 have like numbers with the addition of the suffix "A". As explained in connection with FIGS. 1–10, the pivot points 44 and 46 and consequently the load carried by the attachment 10 moves in an elliptical path of travel. In some applications it may be desirable for the load carrying assembly to move in a straight line. This may be provided by a track 54*a* which is curved in such a manner as to move the pivot points 44*a* and 46*a* in a straight line. In the case shown where the dolly 36*a* is connected to pivot points 48*a* and 50*a* of the parallel arms 30*a* and 32*a* which are not at the mid points of the arms 30*a* and 32*a*, the curve of the track 54*a* will be an ellipse. However if the dolly points 48*a* and 50*a* are connected to the mid point of the arms 30*a* and 32*a*, then the track 54*a* would be a portion of a circle in order for the pivot point 44*a* and 46*a*, and consequently a load carrying system, to move in a straight line.

The present invention, therefore, is well adapted to carry out the objects and attain the ends and advantages mentioned as well as others inherent therein. While a presently preferred embodiment of the invention has been given for the purpose of disclosue, numerous changes in the details of construction and arrangement of parts will be readily apparent to those skilled in the art and which are encompassed within the spirit of the invention and the scope of the appended claims.

What is claimed is:

1. A narrow aisle attachment for use with a lift truck comprising, a carriage plate adapted to be supported from the lift truck, side shifter means supported from the carriage plate, a yoke assembly supported from the side shifter means, a clamp assembly rotatably supported from the yoke, means connected to the clamp assembly for rotating the clamp assembly, means connected to the clamp assembly for opening and closing the clamp assembly, said side shifter means including, a single pair of vertically extending movable parallel arms, a head assembly vertically moving in the carriage plate and pivotally connected to the top ends of each of the parallel arms, the lower ends of the parallel arms pivotally connected to the yoke, a hydraulic piston and cylinder assembly pivotally connected between the parallel arms and the head assembly for shifting said arms transversely to the carriage plate, said assembly having a piston/cylinder located on an outward side of each arm, a dolly assembly including a wheel pivotally connected to each of the arms at points closer to the lower ends than the upper ends of said arms, and a support track positioned on the carriage plate for supporting the wheel, said track being substantially the width of the carriage plate.

2. The apparatus of claim 1 wherein the track is curved for moving the load handling assembly in a straight line.

3. The apparatus of claim 1 wherein the dolly assembly is pivotally connected to each of the arms at locations approximately one-third of the length of the arms from the ends connected to the yoke.

* * * * *